US007478727B2

(12) United States Patent
Grey et al.

(10) Patent No.: US 7,478,727 B2
(45) Date of Patent: Jan. 20, 2009

(54) HOT MAGNETIC SEPARATOR PROCESS AND APPARATUS

(75) Inventors: Thomas J. Grey, Jacksonville, FL (US); Shawn A. Dierickx, Jacksonville, FL (US)

(73) Assignee: Outotec Oyj, Espoo (FI)

( * ) Notice: Subject to any disclaimer, the term of this patent is extended or adjusted under 35 U.S.C. 154(b) by 0 days.

(21) Appl. No.: 11/804,376

(22) Filed: May 18, 2007

(65) Prior Publication Data

US 2008/0283447 A1 Nov. 20, 2008

(51) Int. Cl.
*B03C 1/00* (2006.01)

(52) U.S. Cl. ..... 209/223.2; 209/231; 209/3.2; 209/8

(58) Field of Classification Search ..... 209/3, 209/3.2, 11, 218, 219, 231, 8, 225, 226, 223.1, 209/223.2, 215, 214
See application file for complete search history.

(56) References Cited

U.S. PATENT DOCUMENTS 1,053,486 A * 2/1913 Etherington ..... 423/100
2,026,683 A * 1/1936 Johannsen ..... 75/481
4,000,060 A 12/1976 Collin
4,289,529 A * 9/1981 Kindig et al. ..... 209/9
4,740,239 A * 4/1988 Tuovinen et al. ..... 75/503
6,062,393 A * 5/2000 Knoll et al. ..... 209/219

FOREIGN PATENT DOCUMENTS

DE 3418182 * 11/1985

* cited by examiner

*Primary Examiner*—Patrick H Mackey
*Assistant Examiner*—Mark Hageman
(74) *Attorney, Agent, or Firm*—Arthur G. Yeager

(57) ABSTRACT

System and method for a continuous process for separating particles according to their magnetic properties such as Curie point includes a feed of hot particles having different magnetic properties on a moving surface spaced above a stationary magnetic assembly. The temperature of the bed of particles is controlled to enable selective separation of different factions of particles based upon the temperature of the particles. The magnets are maintained substantially below their Curie point. Gaseous nitrogen is fed into and from the inside of the magnetic assembly to enhance the cooling of the magnetic assembly and to inhibit oxidation. The gas exits through high temperature bearings to inhibit debris therein. A thermal shield is placed between the moving surface and the magnets and below tubes carrying a cooling fluid to maintain magnets substantially below their Curie point. The entire process is contained with an inert gas-purged cabinet.

20 Claims, 9 Drawing Sheets

HOT MAGNETIC SEPARATOR PROCESS AND APPARATUS

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to magnetic separation processes and apparatus and particularly to magnetic separation at elevated temperatures.

2. Related Art

A key shortcoming of traditional magnetic drum separator designs is that the magnets themselves can't survive the elevated temperatures caused by hot material being fed onto the drum, thus the process requires cooling the materials before they can be magnetically separated. The normal limit for many rare earth magnetic drum separators is an operating temperature of 120 degrees Celsius. This area of the industry would need to operate a magnetic separator with feed temperatures in the range of 700 degree Celsius.

There are several temperature points that must be considered in the design of a permanent magnet assembly for a hot magnetic separator:

1. The ambient operating temperature of the magnets is important in material selection.
2. The maximum operating temperature is the temperature at which the magnets can operate more or less indefinitely without degradation of the strength of the magnetic field.
3. For any particular magnet there is a known temperature that results in the onset of degradation and/or demagnetization to a paramagnetic material.
4. The Curie point is the temperature at which the magnets become fully demagnetized into a paramagnetic material.
5. The magnets accordingly should be maintained substantially below their Curie point of the permanent magnets, i.e., equal to or less than 50% of the Curie point temperature.

Magnetic drum separators are well known in the industry. The low intensity dry versions are used to sort highly magnetic material from a material stream, often used to protect the material stream from "tramp iron". Tramp iron, for instance, may be bits and pieces of machinery, or dropped nuts and bolts that should be removed for safety or quality reasons from a material stream. Other higher intensity magnetic drum separators are used to concentrate various magnetic minerals, such as iron ore, and separate some less magnetic materials, such as Ilmenite and garnet (magnetic product) from silica and other contaminants (non-magnetic product). See U.S. Pat. No. 6,062,393.

One physical property of a mineral is its degree of magnetic susceptibility, i.e. the general reference to minerals as being magnetic or non-magnetic. Within the mineral separation arena, materials are further defined based on their varying degrees of magnetic susceptibility. Minerals with varying degrees of magnetic susceptibility can be selectively separated with different stages and types of magnetic separation. The lower strength magnets are employed early in the process to remove the highly magnetic fractions. The following stage or stages utilize greater magnetic fields to capture the less magnetically susceptible minerals.

Some minerals are processed and transformed into other products at high temperatures using special techniques and chemistry. These processes produce product streams that become feedstock for downstream processes, like with pigments or iron and steel manufacturing. The materials separated in these instances, for example, are highly magnetically susceptible iron and highly magnetically susceptible, partially metalized, ilmenite from char, silica, and other contaminants. The industry currently makes this separation at low and reasonable temperatures, but the process economics would benefit greatly if this mixture did not require cooling prior to separation, and subsequent re-heating before being re-introduced into thermal reactors. If one could make this separation at an elevated temperature, one would save all thermal energy lost in the cooling process and all of the re-heat energy. Further savings would come from reduced capital costs for the cooling and reheating equipment.

Currently, there is a technology gap within the minerals processing industry. There is a significant need to magnetically separate materials at as high a temperature as possible. The upper limit for the temperature of this magnetic process is the Curie point or Curie temperature of the magnetic components of the mixture, which is the point where certain magnetic materials undergo a sharp change in the magnetic properties of the material.

The Curie temperature for pure iron is known to be 1043K or about 770 degrees Celsius. For this reason, it was determined the hot magnetic separation process herein needs to manage feed temperatures of up to about 700 degrees Celsius.

The conventional method for manufacturing a magnetic drum separator is as follows: A manufacturer creates a cylindrical drum that rotates on its longitudinal axis utilizing end plates and bearings. This drum assembly rotates on a stationary shaft that also supports the magnetic assembly inside the drum. This way, the drum rotates over a stationary magnet housed inside the rotating drum. The clearance between the inside of the drum and the surface of the magnet is usually minimized to maximize the magnetic field outside the drum, maximizing the separation effect. See U.S. Pat. No. 6,062,393. It is important that this shell be as thin as practical, non-magnetic and wear resistant. The most common material for the shell of this drum assembly is thin stainless steel with a typical thickness of about 3 mm. The most common material for the end plates of the drum is aluminum plate, usually about 19 mm thick. Bearings are attached to the end plates that allow the drum assembly to rotate on the horizontal stationary shaft. These bearings are commonly ball or roller bearings and are either sealed or allow for grease addition for lubrication. The stationary shaft is held in clamps that allow the operator to position the magnetic section for best effectiveness. The magnetic section usually has a pie shape when viewed from its end, and the radius of the magnetic section closely matches the inside radius of the shell. Many separations require maximum magnetic effect so the magnet to shell clearance is minimized. The magnetic section is commonly made from a combination of high strength permanent magnet blocks arranged to maximize the magnetic performance outside the shell.

During operation, the material mixture to be separated is fed in a continuous stream, in the form of a granular or lumpy mixture, directly onto the drum surface, as the drum rotates on its horizontal axis. The drum is rotated using a drive system commonly consisting of a motor and a gearbox sometimes aided by drive belts and pulleys. The feed is normally presented to the rotating drum surface at the twelve o'clock position using a vibratory or rotary feeder and a feed chute. The feed is presented to the drum in a direction that is approximately tangent to the drum surface, and in the direction of rotation. It is desirable to closely match the velocity of the feed material to the velocity of the drum surface to minimize both wear of the drum surface and skipping or bouncing of the particles. Minimizing skipping and bouncing of feed particles improves the separation performance of the magnetic drum separator and reduces wear. Rotation of the drum commonly ranges between 20 and 70 revolutions per minute (rpm) for a drum diameter of about 610 mm.

As the material travels on the drum, the magnetic particles are attracted to the magnet and tend to stick to the drum. The non-magnetic particles tend to leave the surface of the drum through centrifugal forces. Feed materials then take different trajectories based on the degree of magnetic susceptibility, and other physical properties such as mass, shape and density. The operator then selects the positions of one or more movable splitters that direct the material to different hoppers. The most common arrangements are to have either one or two splitters that divide the material into either two products of magnetic and non-magnetic, or three products called magnetic, non-magnetic and middlings. These products are directed away for delivery to a customer, for further processing, or to the scrap or tailings pile.

Another approach of the prior art is illustrated in U.S. Pat. No. 4,000,060 to Collin. This patent seems to suggest the passage of steam and perhaps contaminates from inside the drum and out through the bearings. The bearings would have to be designed to withstand such harsh service. While it is true that such an approach would appear to prevent particulates and hot gases from entering the bearings, the present design employs clean fresh gaseous nitrogen from inside the drum to escape out and through the bearings to cool the bearings and to prevent egress of particulates from entering the bearings from external sources. Therefore the approach of the present invention is clearly preferred.

In addition, Collin '060 includes spraying water within the drum and creating steam to produce a cooling method. The difficulty with that approach involves the fact that rare earth magnets corrode or rust readily in an environment that includes moisture and water.

In the present invention liquid cooling is placed inside a cooling tube circuit instead of allowing direct contact with the magnets. Furthermore, the use of boiling water raises a large number of issues regarding water quality and chemistry control. In addition to scale buildup, there are issues regarding safety and control of boiling water systems. Finally, the accumulation of solids can interfere with close tolerances that exist in the system.

A number of disadvantages arise in the material pickup structure and method of the Collin patent '060, namely:

1. First, trying to lift the magnetic products against gravity and with the assistance of the gas flow exiting at 3 is difficult. Falling material schemes and splitters to divide factions are preferred because of the better control of all three factions when you optimize the separation by manipulating rpm, feed rate, temperature, and splitter positions.
2. Collin '060 needs to pressurize the hot box or cabinet to provide for the escape of gas at 3. The pressure and flow rate that is optimum for the material removal at 3 might not be optimum for the fluidization at 4*a*. Also perfect fluidizing is required to get all particles near the magnetic field so that sorting can occur. This can be accomplished, but as the particle size increases, it becomes more difficult. The small particles will easily fluidize and the big particles will not. The design of this invention rejects this prior art approach and uses the dry drum approach as well known in the prior art, by requiring all particles to pass through the magnetic zone without regard to particle size.
3. An additional issue arises when one is boiling water inside a rotating shell. The temperature of the water and the steam above the water must necessarily be about 100 degrees C. This is near ideal for the better rare earth magnets as they often have a maximum operating temperature of 120 degrees C. The instant design is much better for two reasons: during testing with a significant heat load on the instant shell, the instant magnet assembly remained very near to the coolant temperature of about 10 degrees C. Thus a great deal of safety margin is provided compared to that 120 degrees C. maximum operating temperature of Collin '060. Also, the cooled shell of Collin will very significantly cool the magnetic products and the nonmagnetic products labeled M in FIG. 1, because the shell will be at a temperature of about 100 degrees C. The instant design will accomplish much less cooling, because the shell is at or very near the feed temperature of about 700 degrees C., resulting in low heat transfer out of the feed particles, while maintaining the magnets in a cool state to survive for a long life.

BRIEF SUMMARY OF THE INVENTION

In one aspect of the present invention there is provided a continuous process for separating particles according to their magnetic properties comprising the steps of: feeding a thin bed of hot particles including a plurality of factions of materials having different magnetic properties onto a moving surface spaced closely above a stationary magnetic assembly including a plurality of magnets producing a magnetic flux density capable of producing a coercive force on the factions of particles; controlling the temperature of the bed of particles to enable selective separation of different factions of particles based upon the temperature of the particles in the factions; the feeding step including the step of passing the bed of particles through the magnetic flux for separating the factions of particles, wherein the moving surface travels in a downward path with the particles of respective factions falling from the moving surface at different locations depending on the magnetic attractive strength of each particle to cling to the surface; allowing the falling particles to be separated by means of one or more splitters positioned selectively to divide factions of particles of less magnetic strength from those of greater magnetic strength; and maintaining the temperature of the magnets below the Curie point of the magnets.

Other steps include passing gaseous nitrogen into and from the inside of the magnetic assembly to enhance the cooling of the magnetic assembly; placing a thermal shield between the moving surface and the magnets to maintain the magnets below the Curie point of the magnets; passing an inert cooling gas into the magnetic assembly to purge the magnet assembly of oxygen to minimize oxidation of the magnetic assembly; mounting moving surface on graphite alloy bearings to allow the bearings to operate at elevated temperatures; and passing inert cooling gas into and from inside the magnetic assembly and outside through the bearings to cool the bearings and prevent debris from entering the bearings. The bed of the particles is maintained at a temperature of up to about 800° C. The bed of particles is heated to a temperature above the Curie point of one faction of the factions having different magnetic properties for separating the one faction from the other factions. In addition, the process includes passing a cooling fluid between the moving surface and the magnetic assembly for maintaining the temperature of the magnets below 120° C.; and passing an inert cooling gas into the magnetic assembly to purge the magnet assembly of oxygen to minimize oxidation of the magnetic assembly.

In another aspect of the present invention there is provided apparatus for separating hot particles including a plurality of factions of materials having different magnetic properties comprising a plurality of permanent magnets arranged in a magnetic assembly creating a magnetic flux density capable of providing a coercive force on such particles; a moving surface closely adjacent the magnet assembly for carrying such particles heated above the Curie point of at least one faction of such materials in a downward path through the magnet flux for selective separation of different such factions by dropping the particles from the moving surface at different locations depending on the magnetic properties of such particles; a feed system for supplying such particles onto the moving surface; a control system for controlling the temperature of such particles supplied by the feed system; and a cooling system for maintaining the temperature of the magnets of the magnetic assembly substantially below their Curie point. Also included is a thermal shield located above the magnetic assembly and below the moving surface to shield the magnets from the excessive temperatures of such particles.

The cooling system includes an assembly of cooling tubes carrying a cooling liquid and located above the magnetic assembly and below the moving surface.

A supply of inert fluid and a conduit for supplying the fluid into the magnetic assembly is provided for purging the magnetic assembly of oxygen to minimize oxidation of the magnetic assembly. Bearings are included for mounting the moving surface, and a supply of inert cooling gas and a conduit for supplying the gas into the magnetic assembly for purging the magnetic assembly of oxygen to minimize oxidation of the magnetic assembly and to enhance the cooling of the magnetic assembly. Passageways to direct the inert gas from inside the magnetic assembly outwardly through the bearings to prevent debris from entering the bearings. A housing having an interior space defining a processing zone which includes the moving surface, the magnetic assembly, the feed system, and the cooling system, the housing enclosing the processing zone for maintaining the processing zone at an elevated temperature and substantially filled with the inert gas. The cooling system maintains the temperature of the magnets below 120° C. A splitter is located below the moving surface for selectively dividing factions of particles of less magnetic strength from those of greater magnetic strength.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Overview of the Present Invention

Figure 1:
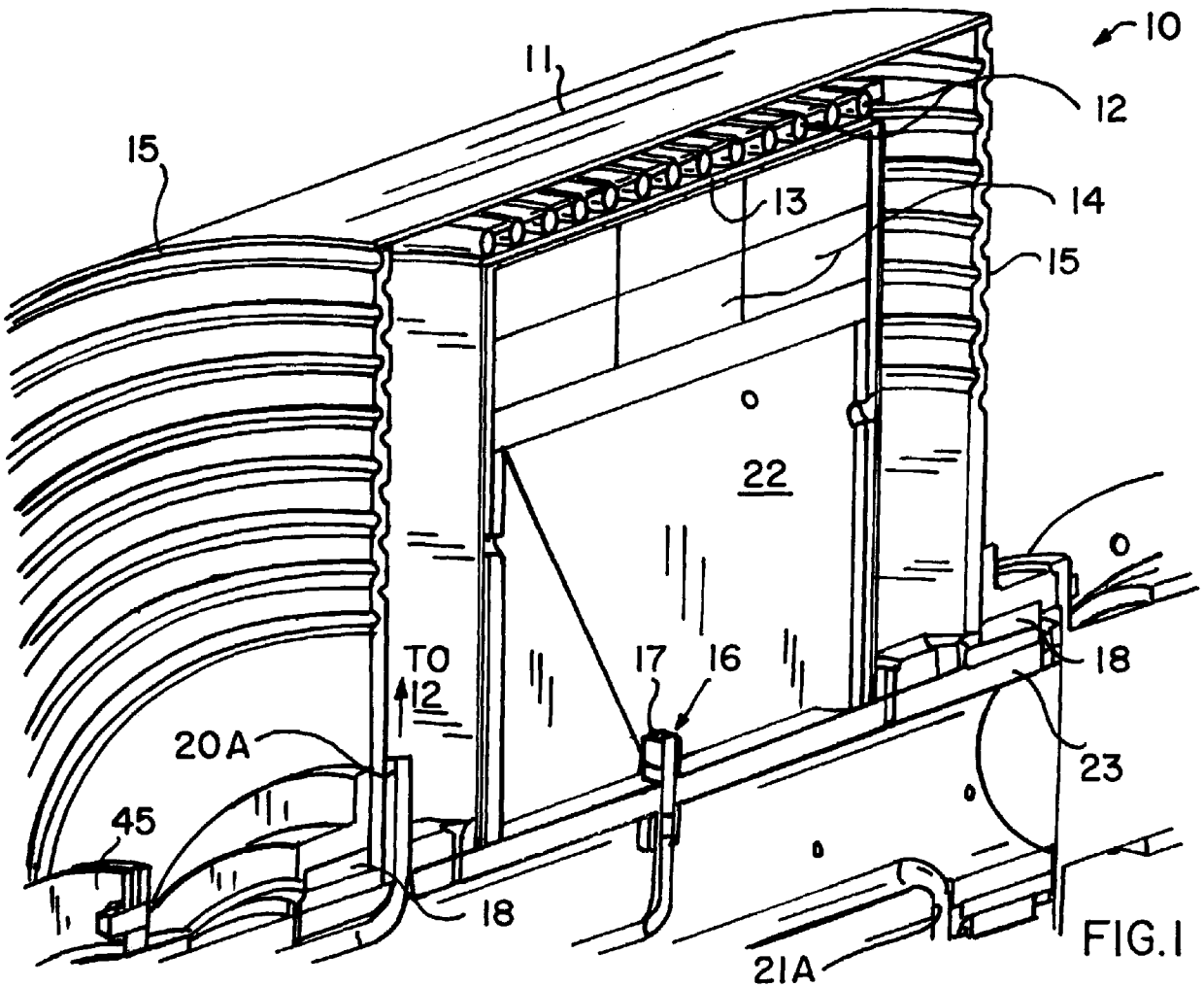
FIG. 1 is a pictorial view of the cooling apparatus used in the hot magnetic separator in accord with the present invention.

The present design is known as a Hot Magnetic Separation Process. This process involves controlling important system variables in order to maximize the separation efficiency of magnetic materials using a Hot Magnetic Separator (HMS). The process requires the control of important system variables in order to maximize the separation efficiency of a Hot Magnetic Separator System. One can control the temperature of the sensitive parts of the processing system by controlling the temperature of the feed and the feed rate. Additionally, by controlling the temperature of the feed one can also control the separation performance. Control of feed temperatures enables selective separation of different fractions based on how they respond to a magnetic field as they approach and exceed their Curie temperature. Many of the new design features are similar to a conventional magnetic drum separator, but with the addition of new features to make it capable of separating feed materials at the Curie temperature of various target feed materials.

The design temperature for the system is about 800 degrees Celsius. Various temperatures are measured within the HMS by thermocouples. The objective is to control both the feed temperature and feed rate for two different purposes: control of the feed rate to control the internal temperature of the magnet drum; and control of the feed temperature to selectively separate materials based on their response to a magnetic field at the chosen temperature. If the optimum temperature for separation efficiency has a wide range, then it is only necessary to control feed rate to control drum temperature. If there is a narrower optimum temperature for separation efficiency, then the control of feed temperature will be at a fixed temperature and variation of the feed rate will be used to control magnet drum temperature.

There is another significant economic benefit to separating the materials at a high temperature. These materials are coming from a hot process. Once separated, the magnetic fraction and the non-magnetic fraction are often being returned to a hot process. So if one can keep these material streams at some elevated temperature during the magnetic separation process, then the plant operator does not have to first cool, then reheat these material streams. The energy savings is significant and easily translated to lower operating costs. In addition, there is less capital cost in the purchase and installation of cooling and reheating equipment.

New Hot Magnetic Separator (HMS)

The new HMS has many of the same characteristics of the conventional Magnetic Drum Separator. The main differences are features that allow the HMS to operate like a conventional Magnetic Drum Separator but at temperatures and environments that would normally destroy such a machine. There are four significant problems caused by high feed temperatures that had to be overcome.

All permanent magnets have a Curie point. As a magnet approaches its Curie point, the magnets begin to lose their magnetic properties. There are several factors that affect this property, but of the most significant is the amount of opposing magnetic field that the magnet is exposed to. This is a condition common to most magnetic assemblies used in a Magnetic Drum Separator. It affects the HMS design in that the magnet material had to be kept well below the Curie temperature of the magnet material itself. The maximum operating temperature of the present magnetic assembly is 120 degrees Celsius. Some references state the Curie point of the permanent magnets as a range of 335 to 370 degrees Celsius and a working temperature substantially below that point in the range of 150 to 200 degrees Celsius.

The magnet temperature problem is addressed by employing a liquid cooled thermal shield around the magnetic assembly. The greatest challenge is how to move the cooling liquid in and out of the drum assembly, noting that the drum shell, endplates, and bearings are driven by a gear-motor and rotating over the stationary magnet assembly. This challenge was overcome by utilizing a hollow shaft. The hollow passage was additionally useful in passing thermocouple wires into the magnetic assembly allowing for monitoring and controlling of the HMS during operation. Lastly, the hollow stationary shaft allows for the supply of gaseous nitrogen to the inside of the drum.

The use of an inert gaseous nitrogen flow from inside the magnet assembly to outside the shell aids the cooling of the magnet assembly. This gas helps remove any heat conducted from the inside of the shell and end plate to the gas spaces inside the drum. Since the gaseous nitrogen is allowed to leak out of the graphite alloy bearings (mentioned below) it prevents gas-borne dust from accumulating in the bearing area, and, most importantly, it keeps highly magnetic dust from entering the magnet volume. If a significant amount of magnet dust were allowed to enter the drum volume it would eventually cause significant operational and performance problems. Last, the gaseous nitrogen that leaks out of the bearings also contributes to the gaseous nitrogen purging of the entire inner volume of the material processing chamber that carries and houses the magnetic drum.

It should be noted that the thermal shield and its cooling coil create extra space between the magnetic assembly surface and the inside surface of the rotating shell. This additional distance, in comparison to a conventional magnetic drum separator, reduces the strength of the magnetic field at the surface of the drum. Because of this, very strong magnets and clever magnetic circuit design must be used to achieve adequate magnetic strength for material separation.

The rotating shell and end plates are either in contact with the high temperature feed material or are very near it. These parts must be designed and made to withstand the high temperatures, abrasive nature, and significant thermal expansion that are caused by a temperature change of up to 700 degrees Celsius. To combat this, high nickel super-alloys, commonly known in the industry, were the chosen materials for the shell and end plates.

The bearings carrying the end plate and shell must survive severe service. Normal ball or roller bearings could only survive this service if closed-loop oil lubrication and cooling system were employed. While this approach is possible, the design instead employed high temperature, self-lubricating graphite alloy journal bearings to simplify the machine and its systems.

The feed material is hot enough to oxidize or burn if exposed to gaseous oxygen. Inert gas is employed for purging of the separation chamber to eliminate this danger and possibility. In addition, a double wall cabinet assembly is used to contain the heat and isolate the operator from the significant danger of any exposed high temperature parts. It was also important to seal the rotating shaft as it passes through the cabinet wall so that high temperature gasses and dust stay contained within the machine. Inert gas is fed into the double wall volume and allowed to pass into the separation chamber to help limit the outer surface temperature. Inert gas is also supplied directly to the separation chamber.

Features that allow the present system to operate in a high temperature and dusty environment:

Choice of high temperature "super-alloys" for the surfaces that are in direct contact with the feed material A thermal shield, and a liquid cooling circuit attached to a liquid chiller to keep the magnet assembly cool enough to survive physically and perform as a magnet. Other methods for cooling the magnet are acceptable. In fact, the magnets could be cooled with a gas system instead.

Use of a gas cooling system that purges heated air from the inside of the magnet assembly.

Use of high temperature Graphite Alloy bearings to allow the bearings to operate at elevated temperatures that would destroy normal ball or roller bearings. Other choices such as ball or roller bearings with oil circulation and cooling systems could also be successfully employed.

Use of a double wall construction for the enclosure of the machine to allow safe operation and access by the operator while keeping the processing zone at a high temperature. The use of a double wall cabinet does not mean that other methods of insulating and protecting the operator could not be successfully employed.

The machine is designed for continuous high temperature service and operation and is supplied with a dedicated liquid chiller for magnet cooling. It is also supplied with a variable frequency drive for rotational speed adjustment of the drum and an instrumentation and control package to monitor critical temperatures within the machine during operation. Several output signals can be generated to control feed temperature and feed rate.

Improvements Over the Prior Art

The following are some of the improvements over the prior art provided in the present invention.

1. Gaseous nitrogen is used to cool the rare earth magnet assembly.
2. The nitrogen enters in the middle of the assembly and exhausts around the bearings for the rotating drum to prevent fine magnetite from entering the drum.
3. The use of nitrogen prevents oxidation of high temperature parts of the drum by excluding oxygen from the interior areas of the drum. In many cases oxidation results in drum and bearing failure due to the buildup of oxidized materials.
4. A glycol/water mixture is used in the cooling tubes to cool and protect the magnet assembly from radiant and convective effects of a heated shell. The magnets must operate with a feed temperature on the shell of up to about 800° C. (1472° F.). The working temperature of the present magnet assembly is 120° C. (248° F.) and is maintained by the glycol/water mixture.

Temperature and Feed Rate Control

One of the principal controls of the present process is control of the temperature of the feed and the feed rate. Thermocouples are wired via the hollow shaft to monitor the temperature at various points. For example, based on experience, one can find the hottest temperature and provide the data to the system controller.

The data may be either the actual temperature of the input feed given a steady state feed rate or alternately, the feed temperature can be controlled by varying the feed rate.

Controlling the temperature of the feed also allows for control of separation performance. Control of feed temperatures enables selective separation of different factions based on how the faction material responds to a magnetic field as the Curie temperature is approached and exceeded. For example, for a first faction with a Curie temperature of 750° C. and a second faction has a Curie temperature of 775° C., the first faction would become paramagnetic whereas the second faction would remain ferromagnetic and be handled as a highly magnetic product. Accordingly, a high degree of separation of the factions could be achieved.

It is to be understood that the change in properties below, at and above the Curie point occurs over a range of temperatures and how distinct or sharp the transition is depends on the various factions and their processing history. The processing history includes heat treatment, chemical treatment, physical treatment, etc.

An Embodiment of the Hot Magnetic Separator

Figure 2:
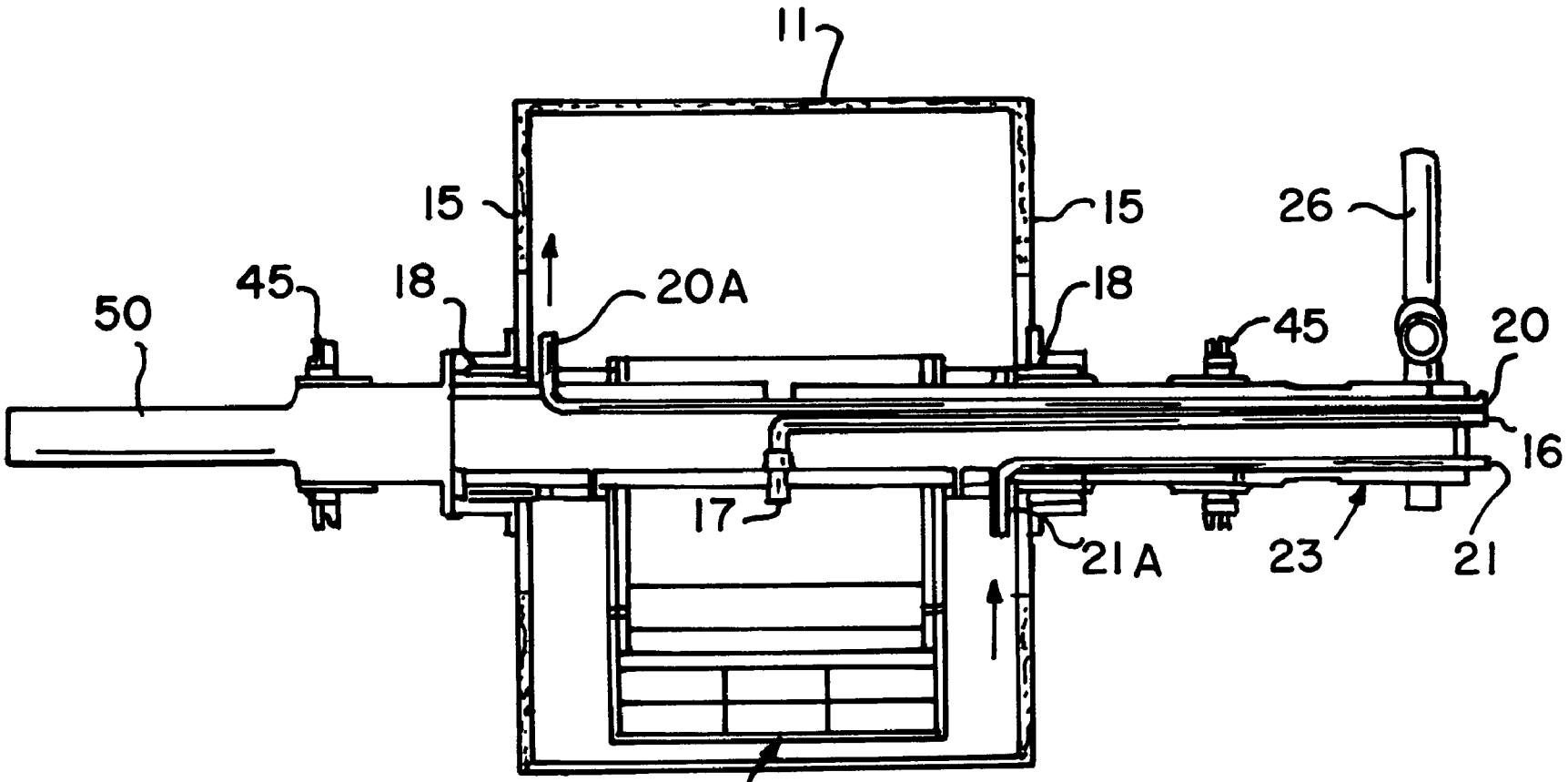
FIG. 2 is a partial cross-sectional view of the hollow shaft and drum assembly in accord with the present invention.
Figure 7:
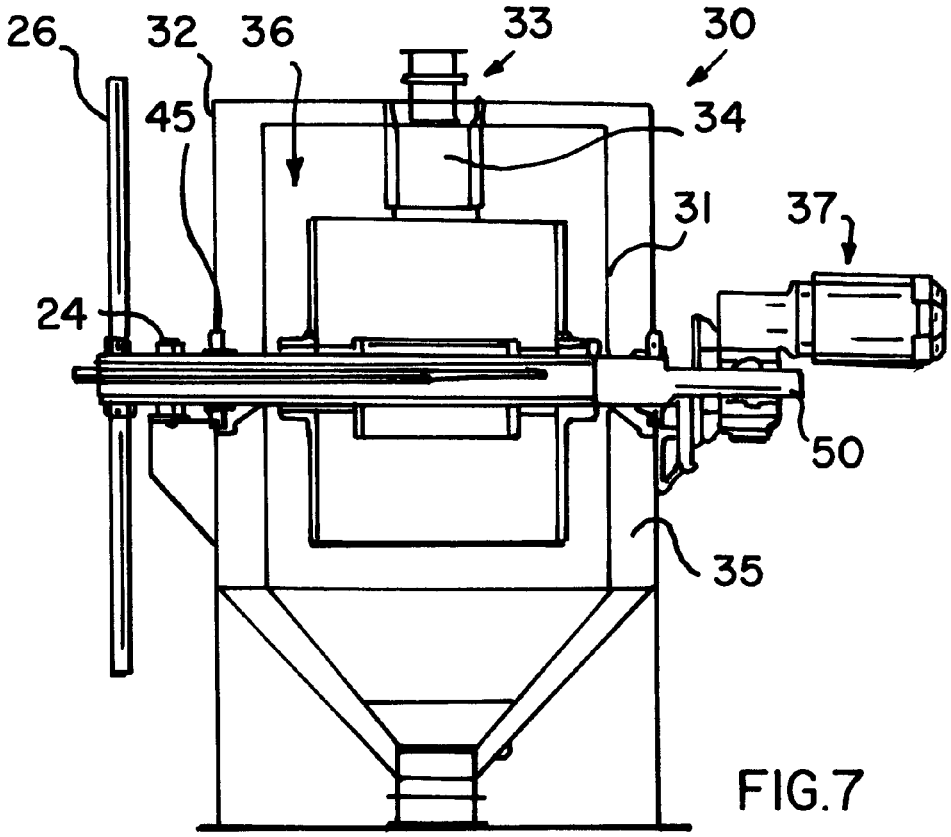
FIG. 7 is a cross-sectional view of the cabinet double walls and shaft seals in accord with the present invention.

With respect now to the drawings, FIGS. 1 and 2 show the general layout of the drum separator. The hot magnetic separator drum 10 includes a shell 11 formed of a high nickel super-alloy having grooved end plates 15 also formed of the same material as the shell 11. A cooling system includes an array of cooling tubes 12 that receive a glycol/water mixture via inlet 20 through an extension 20A shown in cutaway. The heated mixture exits via extension 21A out through outlet 21 also shown in cutaway. The cooling system also includes a heat shield 13 mounted below cooling tubes 12 and above rare earth magnet assembly 22 including magnets 14. The cooling system further includes gaseous nitrogen introduced from supply 16 via medially located conduit including inlet nozzle 17. Stationary hollow shaft 23 is carried by shaft clamp 24, as shown in FIG. 7. The drum 10, bearing housings and graphite alloy bearings 18 rotate on and around stationary shaft 23 and relative to magnet assembly 22.

Figure 3:
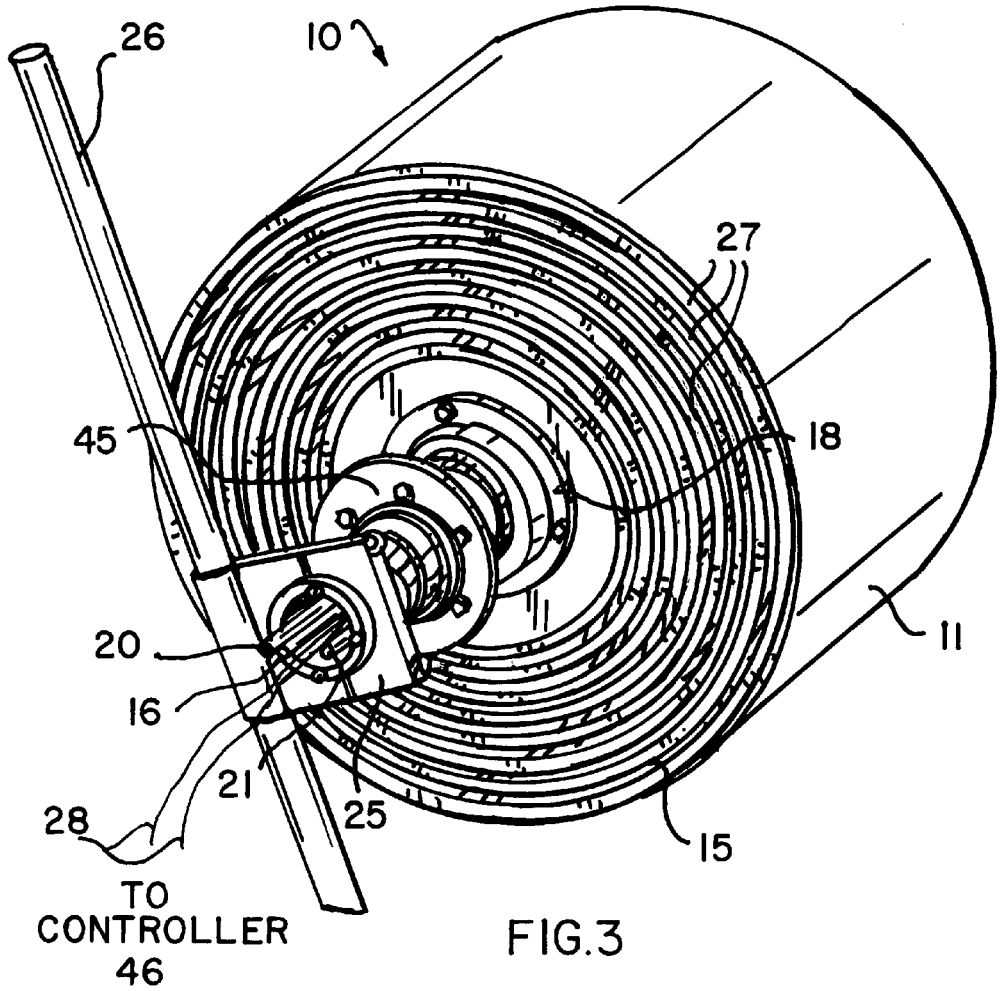
FIG. 3 is a perspective view of the cooling connections and gas purging connection in accord with the present invention.
Figure 4:
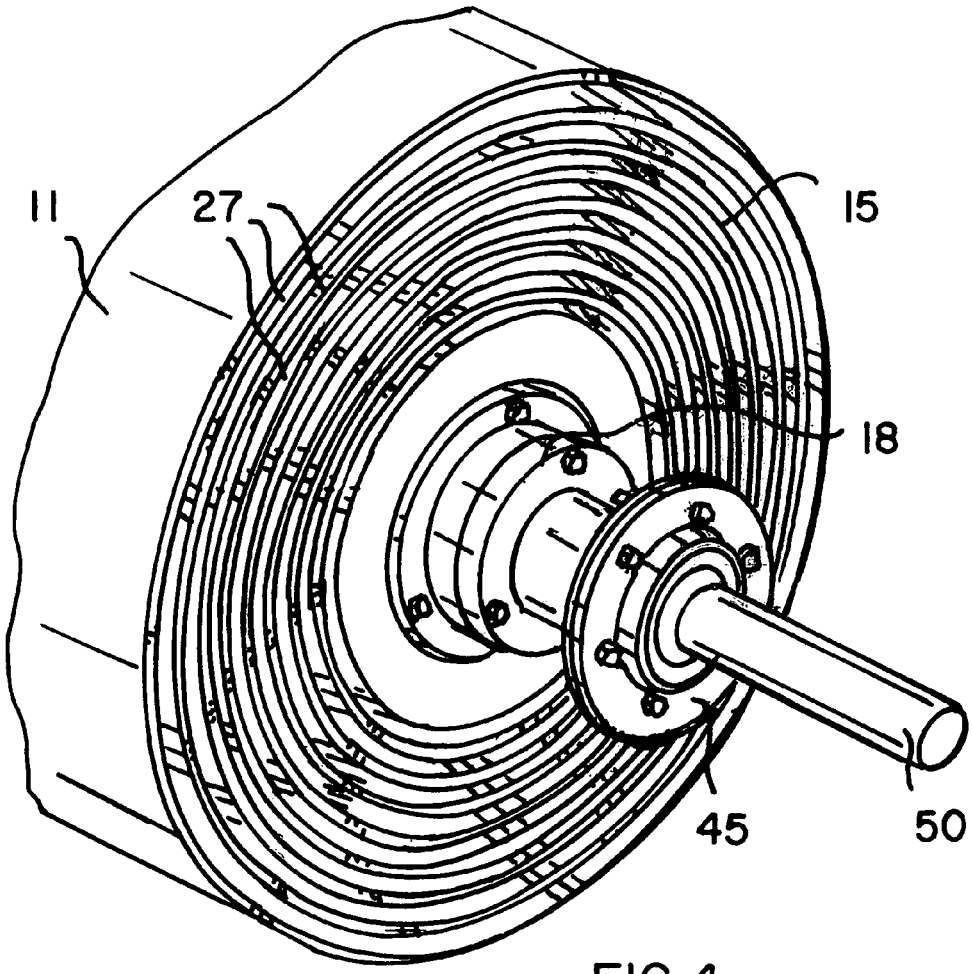
FIG. 4 is a perspective view of an end plate and shaft in accord with the present invention.
Figure 5:
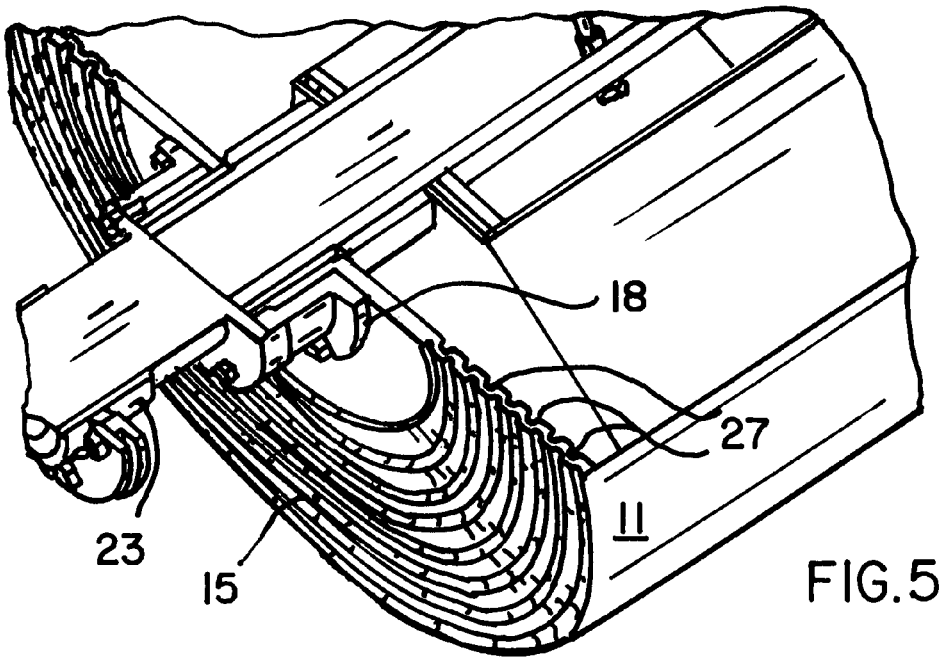
FIG. 5 is a cutaway view of an end plate and shaft in accord with the present invention.

FIGS. 3-5 illustrate an end plate 15 and removable lever 26 which carries bracket 25. The lever 26 and bracket 25 allow the operator to reposition the relative rotational position of the stationary magnet assembly 22. The selected position is locked into place by tightening shaft clamp 24. The end of shaft 23 provides the passage for the nitrogen supply 16 as well as thermocouple wires 28 (thirty-two in number for sixteen sensors) used for monitoring the temperature at all locations in the entire system as desired. Preferably, end plates 15 include a plurality of grooves 27 formed therein for increased thermal path and increased flexibility to accommodate thermal expansion and contraction of shell 11.

Figure 6:
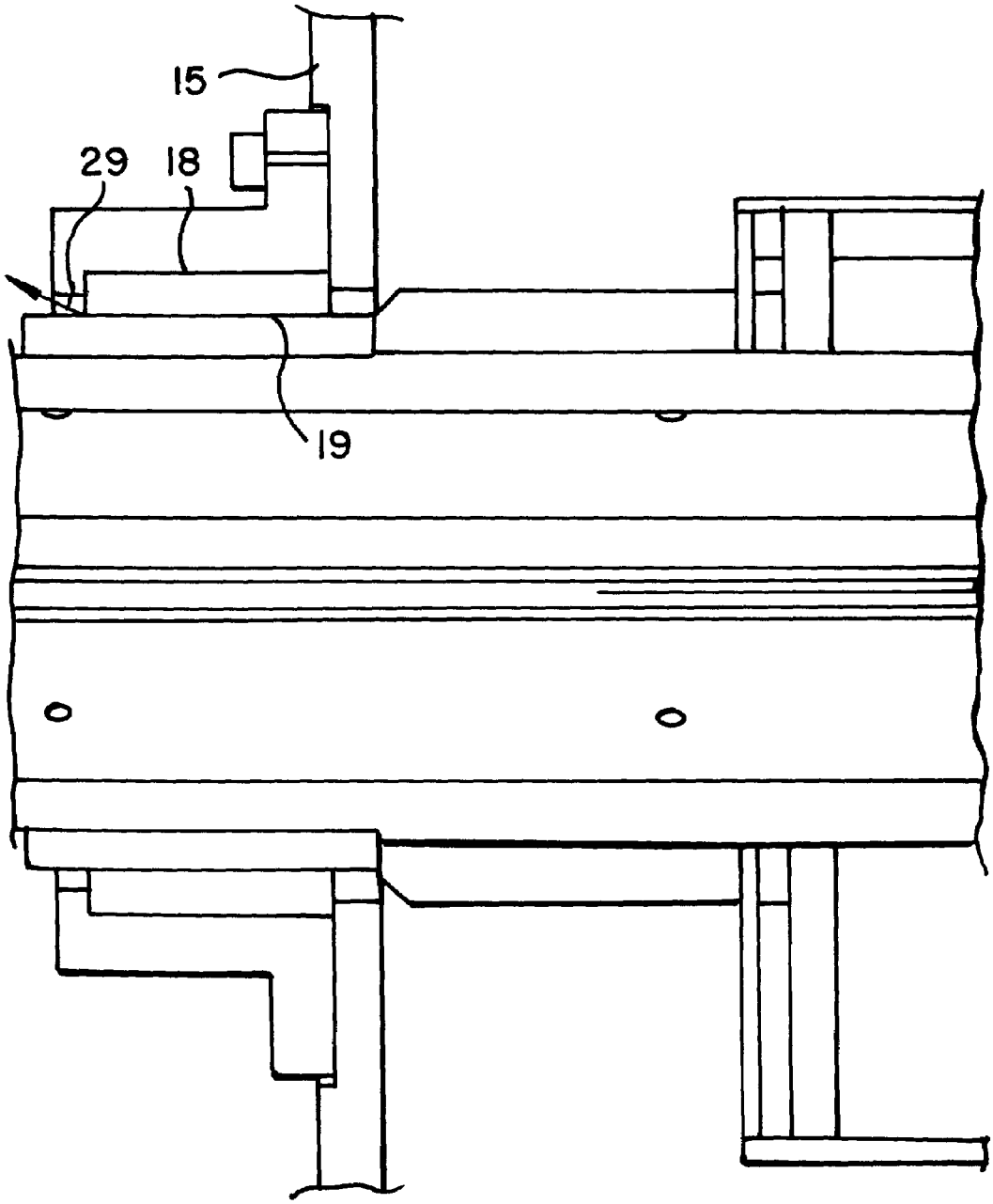
FIG. 6 is a cross-sectional view of the hollow shaft and graphite alloy bearing in accord with the present invention.

FIG. 6 shows a portion of the hollow shaft 23 and graphite alloy bearings 18 at one end thereof in cross-section. Arrow 29 indicates the flow of nitrogen gas through the bearings 18 via outlet spaces 19.

Figure 9:
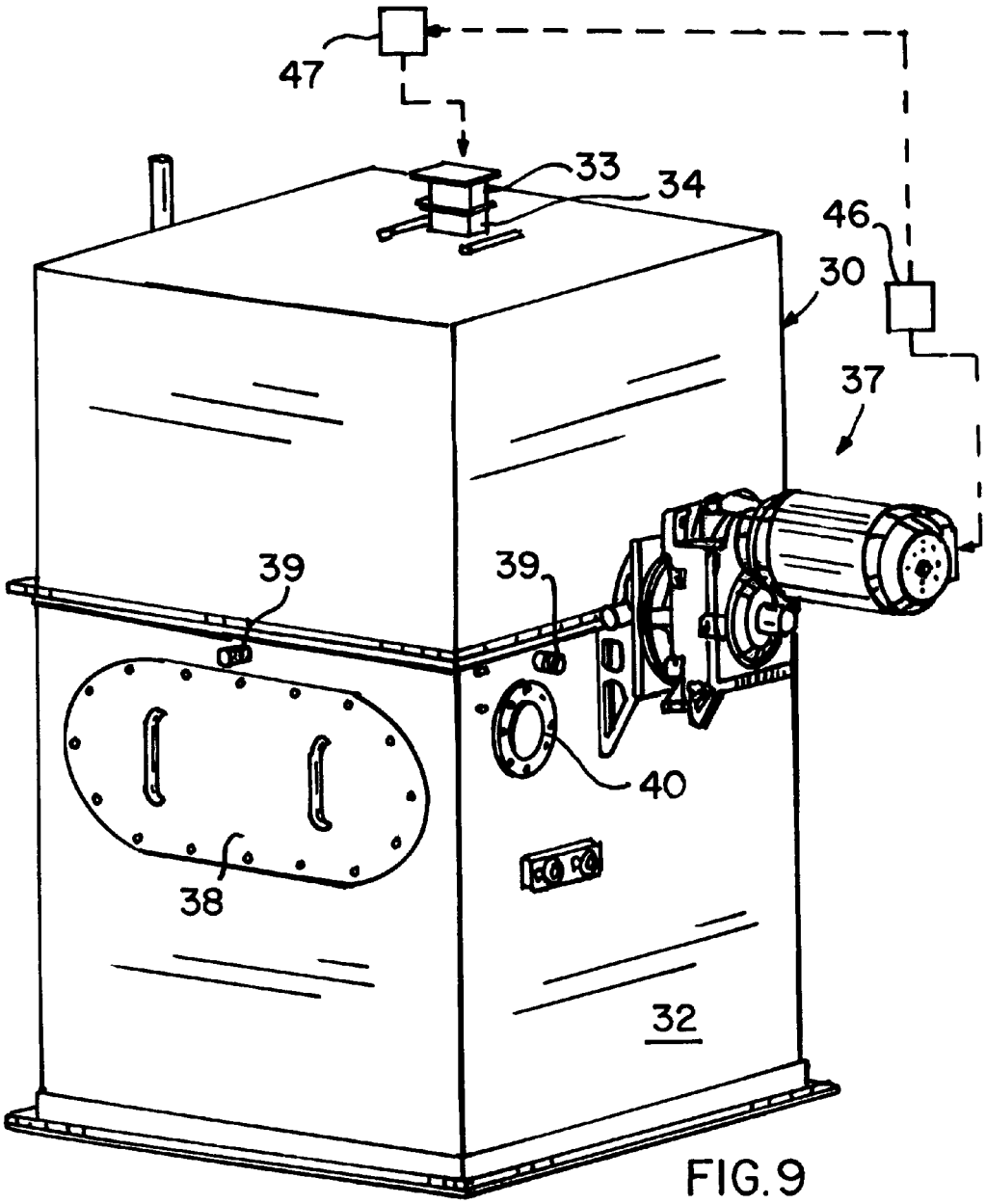
FIG. 9 is a perspective view of the present assembly shown from the drive side.
Figure 10:
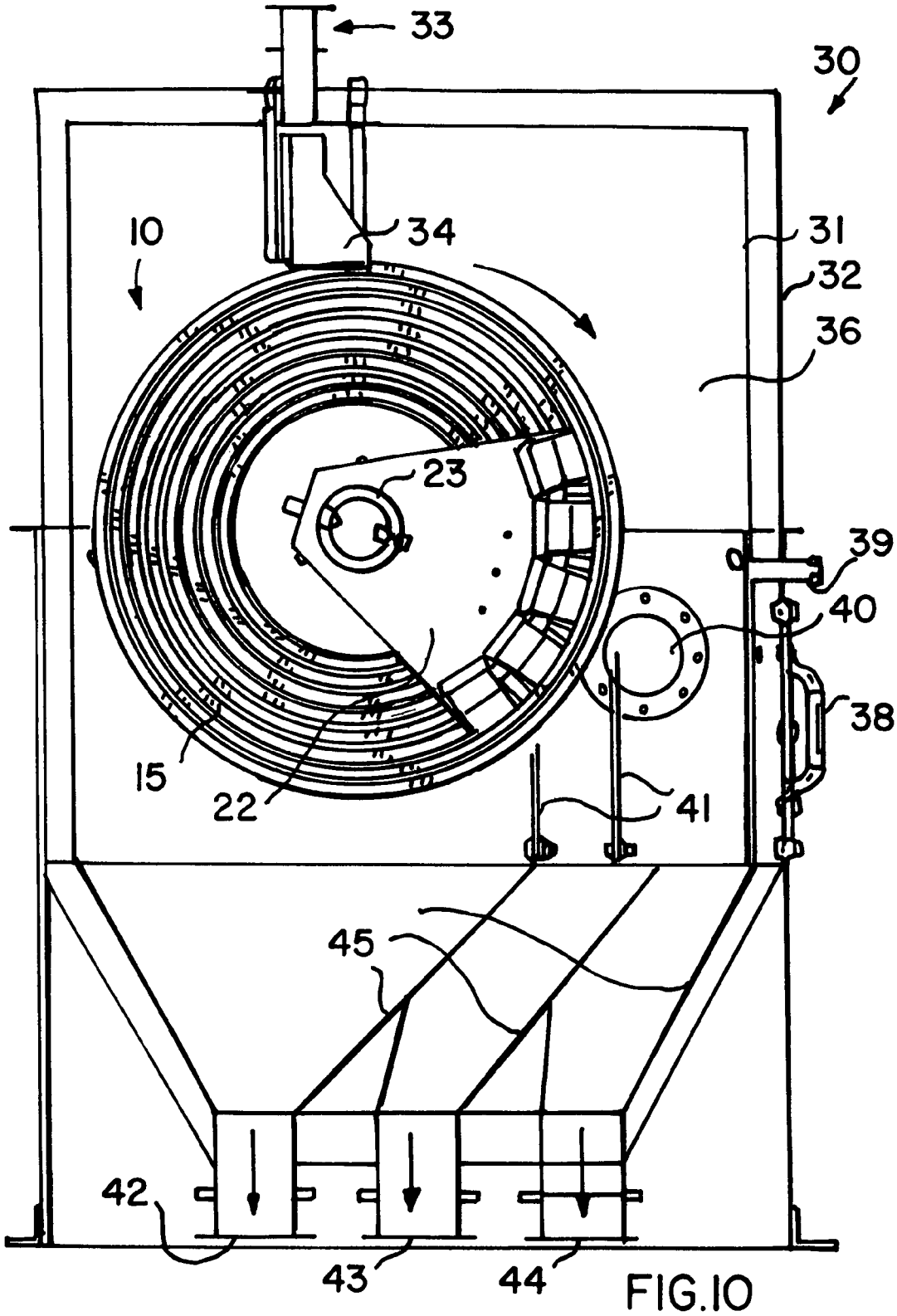
FIG. 10 is a cross-sectional view across the shaft of the apparatus shown in FIG. 9.

FIGS. 7, 9 and 10 illustrate housing in the form of cabinet 30 having inner and outer walls 31, 32. The inlets include an 80 mm wide feed connection 33 and a 150 mm wide feed chute 34.

Figure 8:
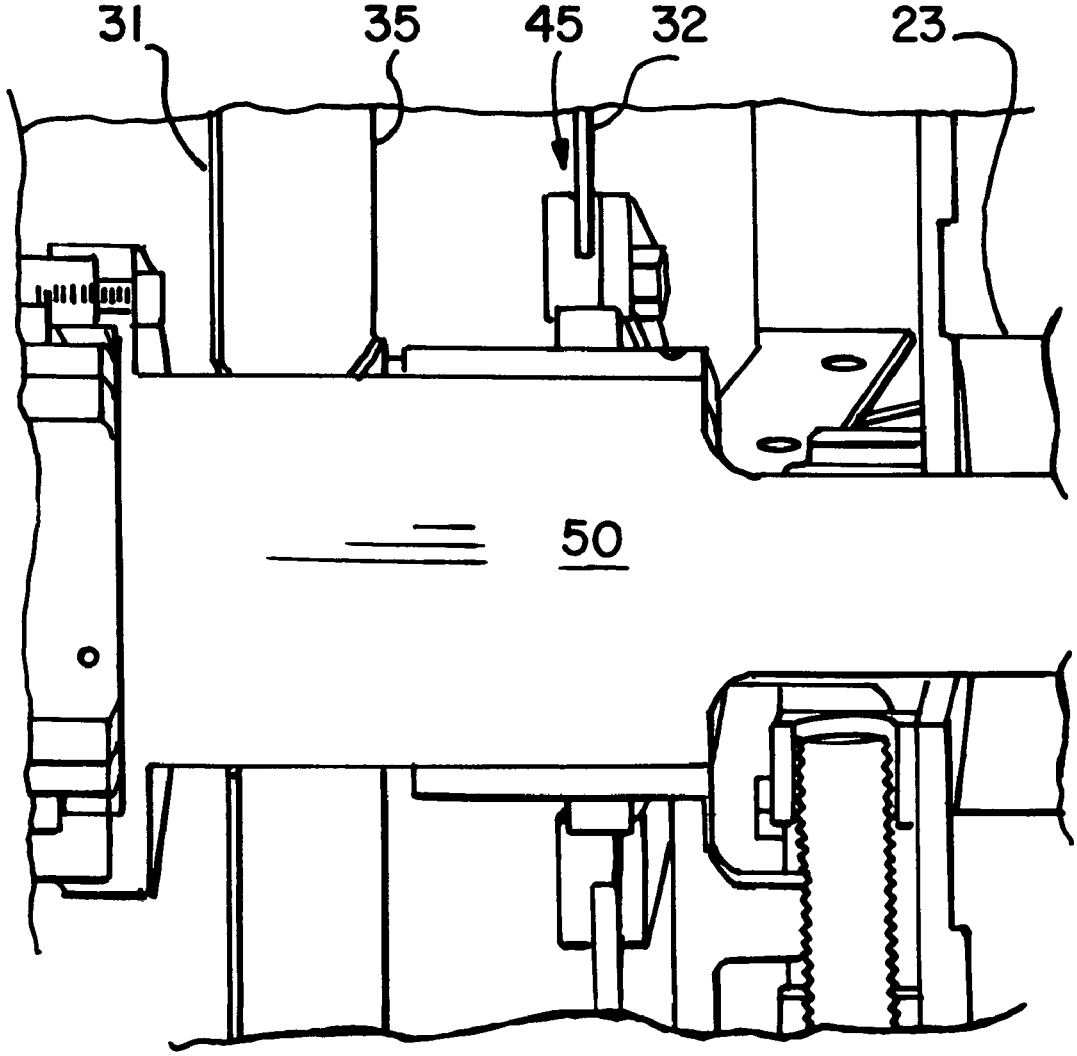
FIG. 8 is an enlarged view of a portion of FIG. 7.

Cabinet 30 has an inert gas-purged interior space 35 to maintain the separator apparatus at the desired high temperature. FIG. 8 illustrates an enlarged detail of the solid drive shaft 50, via shaft sealing 45, mounting through walls 31, 32.

FIG. 9 illustrates inspection door 38, temperature probe ports 39, viewing window 40 of cabinet 30 and system controller 46. Incoming feed from feed system 47 is supplied to apparatus 33, 34 and is controlled via controller 46 based in part on temperature data via wires 28 and any other appropriate data.

FIG. 10 is a cross-sectional view of the separator apparatus across the hollow stationary shaft 23 and inside cabinet 30. Splitters 41 divide magnetic material, and non-magnetic material into appropriate chutes 45 for further handling as appropriate via respective material collectors 42, 43, 44.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A continuous process for separating hot particles according to their magnetic properties comprising the steps of:

(a) feeding a thin bed of hot particles including a plurality of factions of particles having different magnetic properties onto a moving surface spaced closely above a stationary magnetic assembly including a plurality of permanent magnets producing a magnetic flux density capable of producing a coercive force on the factions of particles;

(b) controlling the temperature of the bed of hot particles to enable selective separation of different factions of particles based upon the temperature of the particles in the plurality of factions;

(c) the feeding step including the step of passing the bed of hot particles through the magnetic flux for separating factions of particles from the other factions of particles, wherein the moving surface travels in a downward path with the particles of respective factions falling from the moving surface at different locations depending on the magnetic attractive strength of each particle to cling to the surface;

(d) allowing the falling particles to be separated by means of one or more splitters positioned selectively to divide factions of particles of less magnetic strength from those of greater magnetic strength; and (e) maintaining the temperature of the magnets substantially below the Curie point of the magnets by passing a contained cooling liquid between the magnetic assembly and the moving surface.

2. The process of claim 1 further including the step of:

(f) passing gaseous nitrogen into and from the inside of the magnetic assembly to enhance the cooling of the magnetic assembly.

3. The process of claim 1 further including the step of:

(f) placing a thermal shield between the contained cooling liquid and the magnetic assembly to maintain the magnets substantially below the Curie point of the magnets.

4. The process of claim 1 further including the step of:

(f) passing an inert cooling gas into the magnetic assembly to purge the magnet assembly of oxygen to minimize oxidation of the magnetic assembly.

5. The process of claim 1 further including the step of:

(f) mounting the moving surface on graphite alloy bearings to allow the bearings to operate at elevated temperatures.

6. The process of claim 5 further including the step of:

(g) passing inert cooling gas into and from inside the magnetic assembly and outside through the bearings to cool the bearings and prevent debris from entering the bearings.

7. The process of claim 1 further including heating and maintaining the bed of the particles at a temperature of about 800° C.

8. The process of claim 1 further including the step of:

(f) heating the bed of particles to a temperature above the Curie point of one faction of the plurality of factions having different magnetic properties for separating the one faction from the other factions.

9. The process of claim 1 further including the step of:

(f) providing cooling tubes carrying the cooling liquid between the moving surface and the magnetic assembly for maintaining the temperature of the magnets below 120° C.

10. The process of claim 1 further including the steps of:

(f) passing an inert cooling gas into the magnetic assembly to purge the magnet assembly of oxygen to minimize oxidation of the magnetic assembly; and (g) heating the bed of particles to a temperature above the Curie point of one faction of the factions having different magnetic properties for separating the one faction form the other factions.

11. The process of claim 10 further including the step of:

(h) heating the bed of particles to a temperature above the Curie point of one faction of the factions having different magnetic properties before step (a) for separating the one faction from the other factions in step (d).

12. Apparatus for separating hot particles including a plurality of factions of materials having different magnetic properties comprising:

a plurality of permanent magnets arranged in a magnetic assembly creating a magnetic flux density capable of providing a coercive force on such particles;

a moving surface closely adjacent said magnet assembly for carrying such particles heated above the Curie point of at least one faction of such materials in a downward path through said magnet flux for selective separation of different such factions by dropping said particles from said moving surface at different locations depending on the magnetic properties of such particles;

a feed system for supplying such hot particles onto said moving surface;

a control system for controlling the temperature of such particles supplied by said feed system; and a cooling system for maintaining the temperature of said magnets of said magnetic assembly substantially below their Curie point by passing a contained cooling fluid between said magnetic assembly and said moving surface.

13. The apparatus as defined in claim 12 further including a thermal shield located above said magnetic assembly and below said moving surface to shield said magnets from the excessive temperatures of such particles.

14. The apparatus as defined in claim 12 wherein said cooling system includes an assembly of cooling tubes carrying a cooling fluid and located above said magnetic assembly and below said moving surface.

15. The apparatus as defined in claim 12 further including a supply of inert gas and a conduit for supplying said inert gas into said magnetic assembly for purging said magnetic assembly of oxygen to minimize oxidation of said magnetic assembly.

16. The apparatus as defined in claim 12 further including bearings for mounting said moving surface, and a supply of inert cooling gas and a conduit for supplying said gas into said magnetic assembly for purging said magnetic assembly of oxygen to minimize oxidation of said magnetic assembly and to enhance the cooling of said magnetic assembly.

17. The apparatus as defined in claim 16 further including passageways to direct said inert gas from inside said magnetic assembly outwardly through said bearings to prevent debris from entering said bearings.

18. The apparatus as defined in claim 17 further including a housing having an interior space defining a processing zone which includes said moving surface, said magnetic assembly, said feed system, and said cooling system, said housing enclosing said processing zone for maintaining said processing zone at an elevated temperature and substantially filled with said inert gas.

19. The apparatus as defined in claim 12 wherein said cooling system maintains the temperature of said magnets below 120° C.

20. The apparatus as defined in claim 12 further including at least one splitter located below said moving surface for selectively dividing factions of particles of less magnetic strength from those of greater magnetic strength.

* * * * *